United States Patent [19]

Yulkowski

[11] Patent Number: 4,545,607

[45] Date of Patent: Oct. 8, 1985

[54] DOOR CONSTRUCTION

[76] Inventor: Leon Yulkowski, 40 W. Howard, Pontiac, Mich. 48058

[21] Appl. No.: 422,252

[22] Filed: Sep. 23, 1982

[51] Int. Cl.[4] ..... E05C 3/26

[52] U.S. Cl. ..... 292/216; 292/210; 70/135

[58] Field of Search ..... 292/45, 49, 108, 166, 292/181, 195, 210, 213, 214, 216, 221, 336.3; 70/135–137, 139, 469, 472, 477

[56] References Cited

U.S. PATENT DOCUMENTS

| | | | |
|---|---|---|---|
| 1,528,515 | 3/1925 | Taylor | 70/135 X |
| 3,337,249 | 8/1967 | Russell | 292/336.3 X |
| 3,337,251 | 8/1967 | Russell et al. | 292/210 X |
| 3,477,755 | 11/1969 | Russell et al. | 292/49 X |
| 3,969,845 | 7/1976 | Yulkowski | 292/216 X |
| 4,093,284 | 6/1978 | Yulkowski | 292/216 |

FOREIGN PATENT DOCUMENTS

| | | | |
|---|---|---|---|
| 952644 | 11/1949 | France | 70/135 |

*Primary Examiner*—Robert L. Wolfe
*Attorney, Agent, or Firm*—Cullen, Sloman, Cantor, Grauer, Scott & Rutherford

[57] ABSTRACT

In a door hinged to a frame having a locking channel pivotally mounted upon a vertical axis upon its closing edge aligned with the door and interlocked with an elongated engaging element upon the frame, the channel being sufficiently movable relative to the door that it disengages the engaging element so that the door may open, and a blocking member movably mounted upon the door in one position retaining the channel in a locked position when the door is closed and movable to a release position; the improvement comprising; a lever or knob rotatably mounted upon the door and a linkage movably mounted upon the door interconnecting the lever or knob with the blocking member for moving the blocking member to its release position so that the channel moves to disengage the engaging element. The linkage includes a clutch operated actuator pivoted upon the door in operative engagement with the blocking member. Between a pair of symmetrical escutcheons are a pair of lever mounting rotatable hubs which support a pivotal clutch selectively connectable to the hubs. A turnpiece hub controls locking and unlocking of the door and a lock cylinder selectively engages the turnpiece hub.

17 Claims, 9 Drawing Figures

UNLOCKED

DOOR CONSTRUCTION

BACKGROUND OF THE INVENTION

Applicant's U.S. Pat. No. 3,969,845 dated July 20, 1976 directed to a door construction disclosed a door hinged to a frame having a locking channel pivotally mounted upon a vertical axis upon its closing edge and interlocked with an elongated engaging element upon the frame wherein the channel was sufficiently movable relative to the door that it disengaged the locking element so that the door may open.

A blocking means was movably mounted upon the door, in one position retaining the channel in a locked position when the door was closed and movable to a channel release position. Said patent further disclosed a manually releasable blocking means upon the door for preventing pivotal movement of the channel with respect to the door.

Applicant's improvement U.S. Pat. No. 4,093,284 dated June 6, 1978 was further directed to a door construction wherein additionally there was disclosed a pivotal actuator within the door in operative engagement with a channel blocking member together with push pull type of control assembly mounted upon the door and operatively engageable with the actuator for moving the actuator, and in turn the channel blocking means from a locked position to a release position.

SUMMARY OF THE INVENTION

The present invention is directed to an improvement by which levers or knobs on opposite sides of the door utilizing a clutch mechanism in connection with a linkage assembly can control the unlatching or unlocking of the door channel and its pivotal movement with respect to a door frame.

It is an object of the present invention to provide a control mechanism and linkage assembly for a pivotal actuator for regulating the movement of the channel blocking member between lock position and release position.

It is a further feature of the present invention to provide a pair of opposed symmetrical escutcheons having opposed inwardly directed pairs of support hubs or bosses within which a linkage mechanism for controlling the actuator includes a rotatable clutch supported and journaled upon the escutcheons and mounting a depending control pin movably nested within a cam slot within the actuator whereby tilting movement of the clutch housing in one plane effects a corresponding tilting movement of the actuator in a second plane for moving the channel blocking member to a release position.

A further feature includes the use of a pair of levers of knobs which are rotatably mounted upon the escutcheons in suitable hubs thereon wherein the clutch housing is supported solely between the escutcheons journaled and supported upon the hubs.

A further feature includes the mounting of a spring biased dog upon the clutch housing which is in registry with one of the hubs whereby rotation of the lever or knob rotates said hub and simultaneously rotates the clutch housing operating the actuator to move the channel blocking member to a release position.

A further feature includes a pivotally mounted cam jounaled and supported between the escutcheons adapted for operative engagement with the dog together with a manually operable turnpiece hub also rotatably mounted upon and between the escutcheons, having an unlocked position and a locked position, wherein the turnpiece hub includes a plurality of peripherally spaced detents to operatively engage the cam for depressing the dog into operative engagement with the other hub upon said door whereby the corresponding lever or knob mounted upon said second hub is capable of rotating the clutch housing, the door being in an unlocked condition.

A further feature includes the manual rotation of the turnpiece hub to a locked position wherein the turnpiece hub is disengaged from the cam and the dog upon the clutch is biased out of engagement with the second hub so that the lever on the second hub is ineffective to rotate the clutch housing and unlock the door.

A further feature includes elongated clutch operating arm upon the clutch housing in the path of rotary movement of the turnpiece hub whereby the turnpiece hub is effective for rotating the clutch housing for an unlatching action.

As a further feature of the present invention wherein with the turnpiece hub in a locked position, there is provided a key operated cylinder supported between and upon the escutcheons which includes a rotatable cam operatively engageable with the turnpiece hub for successively on rotation thereof effecting corresponding rotation of the clutch housing for moving the actuator to move the channel blocking member to a release position for opening the door.

In accordance with the present invention there is provided a lever or knob, used and referred to as equivalent wherein either the lever or the knob is supported upon a corresponding rotatable hub, journaled and supported upon the escutcheons, wherein the clutch housing is adapted for operative control engagement with an actuator for releasing the door channel, the clutch housing being journaled and supported between the escutcheons upon said hubs, and wherein a turnpiece hub is journaled and supported between the escutcheons and controls the function of the clutch housing for maintaining the door locked and wherein the exterior lever is ineffective to unlatch or unlock the door. Key operated rotatable cylinder is supported between the escutcheons and carries a rotatable cam adapted to operatively drive the turnpiece hub and in turn moving the clutch housing for an unlocking function.

A further feature provides a lever and linkage mechanism whereby the door may be locked with respect to a frame without the use of deadbolts or latches.

A further feature is to provide a lock control mechanism which does not require a housing wherein the escutcheons themselves position all of the mechanism components within the door for rotative or other adjustment and for mounting the levers and hubs therefor wherein no housing is required.

These and other objects and features will be seen from the following specification and claims in conjunction with the appended drawings;

THE DRAWINGS

FIG. 1 is a fragmentary plan view of a door hinged within a frame including on the locking edge a pivotally mounted channel interlockable with a portion of the frame which is adapted for pivotal movement to permit opening of the door exemplifying the prior art.

FIG. 2 further illustrates a prior art assembly door and its pivotal locking channel mounted within a frame showing the channel in a locked position.

It will be understood that the above drawings illustrate merely a preferred embodiment of the invention and that other embodiments are contemplated within the scope of the claims hereafter set forth.

DETAILED DESCRIPTION OF AN EMBODIMENT OF THE INVENTION

Figure 1:
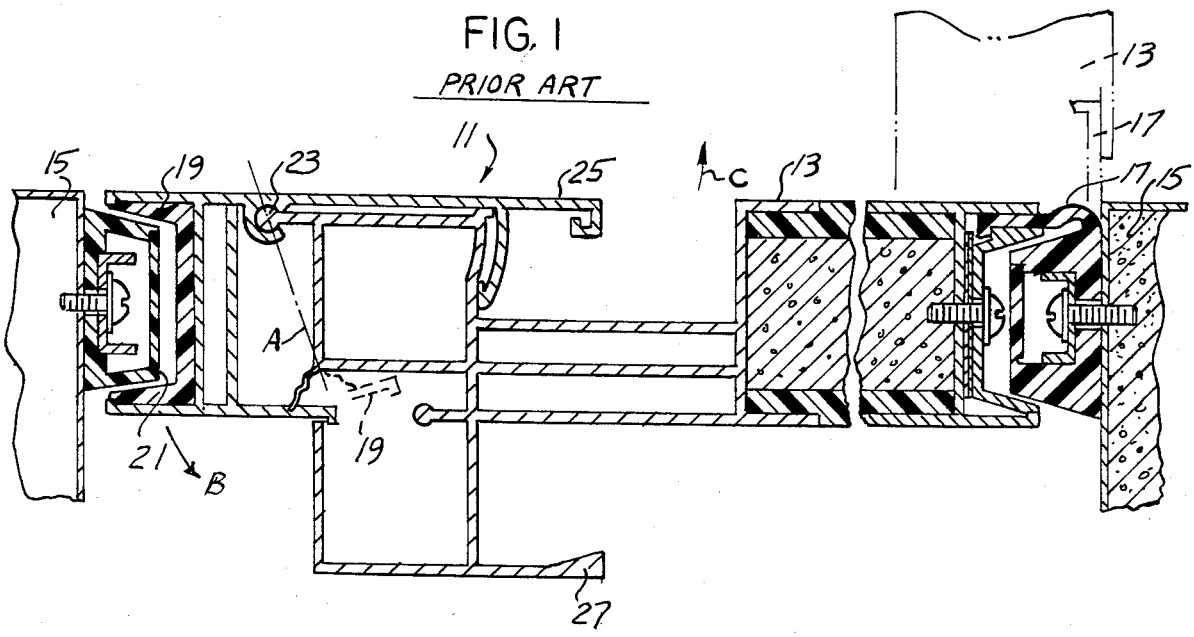
FIG. 1 PRIOR ART

FIG. 1 is illustrative of the prior art which corresponds to Applicant's U.S. Pat. No. 3,969,845 related to a door construction 11 including a door 13 positioned within a convention frame 15 hinged along one upright edge as at 17. Mounted upon its closing edge is an upright elongated locking channel 19 which extends for a substantial portion of the door height or for the full door height, which is shown in an interlocked relation with respect to an engaging element 21 mounted upon frame 15. Locking channel 19 is pivotally mounted upon a vertical axis 23 upon and along the closing edge of the door 13. Handles 25 and 27 are mounted upon opposite sides of the door for opening and closing the door as designated by the arrow C. The direction of unlocking movement of the channel 19 being shown by the arrow B, the locking channel rotating within the pivot plane A.

Figure 2:
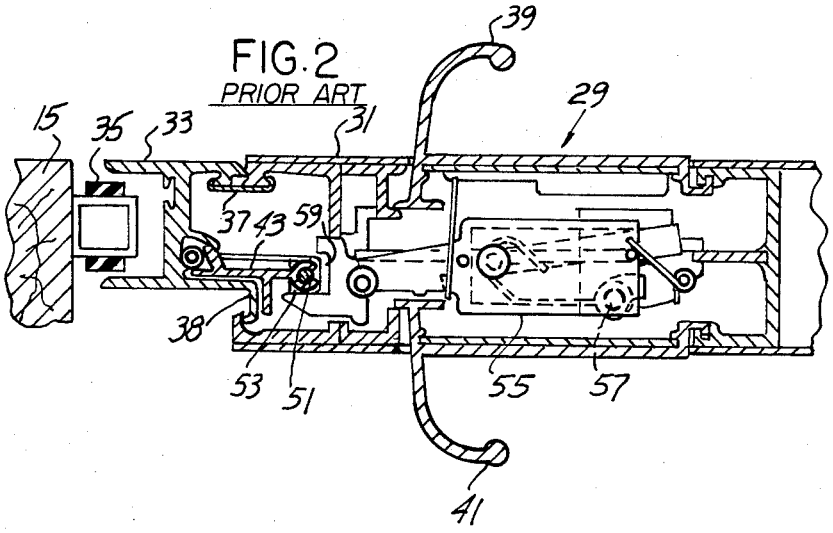
FIG. 2 PRIOR ART
Figure 3:
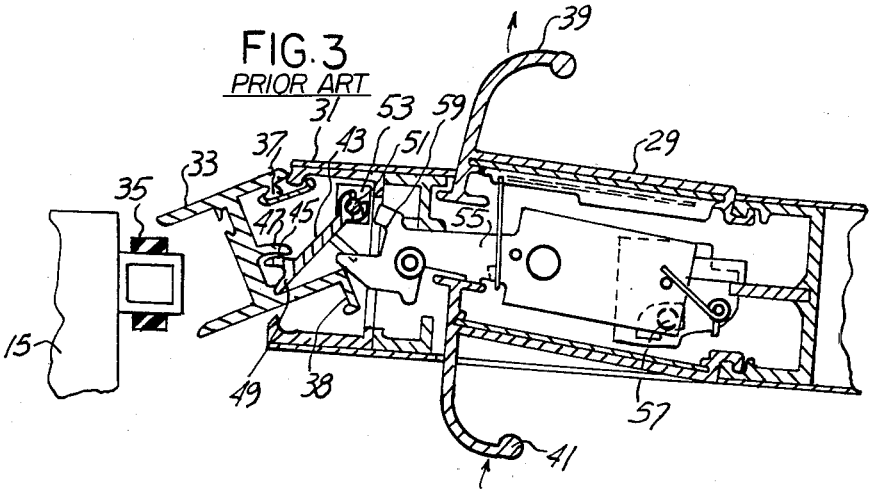
FIG. 3 PRIOR ART
FIG. 3 is a similar view to that of FIG. 2 showing the channel in an unlocked position with the door partly opened.

FIGS. 2 and 3 are partly illustrative of the prior art showing a door construction 29 in accordance with the U.S. Pat. No. 4,093,284 showing a door 31 similar to the present door which is pivotally mounted within the frame 15 the same as shown in FIG. 1, and corresponds to the present door including locking channel 33 aligned with the door and in retaining engagement with the locking element 35 which extends substantially the height of the door opon the frame 15. The door 31 of the present invention is pivotally mounted upon a vertical axis as designated at 17 wherein the channel 33 has a channel stop 38 engageable with the door for a limiting pivotal movment of the channel in one direction. Said channel is pivotally mounted upon a vertical axis by the channel hinge 37 upon the closing edge of the door.

Handles 39 and 41 are is shown in FIGS. 2 and 3 connected to the door for swinging the door open when the channel is capable of moving to the unlocked position shown in FIG. 3, when the blocking member 43 for the channel has been rotated from the channel blocking position, FIG. 2 to the channel release position, FIG. 3.

The blocking member 43 at one end has an arcuate boss 45, FIG. 3, in registry with a corresponding arcuate boss 47 on channel 33. The blocking member 43 further includes a pivotal edge 49 which stays in operative retaining engagement with said channel. The opposite upright portion of the blocking member 43 has a pivot pin 51 upon which is mounted a sleeve 53 for forming a part of the blocking member.

As shown in FIGS. 2 and 3, actuator 55 is pivotally mounted at one end at 57 upon a portion of the door and at its opposite end includes the notch or clevice 59 in registry with the blocking member 43, FIG. 2, wherein when the actuator has been rotated in a horizontal plane from the position shown in FIG. 2 to the position shown in FIG. 3, said actuator has moved the blocking member 43, to a release position so that the channel 33 is free to pivot to the unlocked angular position facilitating opening of the door 31.

Accordingly, FIGS. 2 and 3 show the environment in which the present door 31 is hingedly mounted and for background shows the relationship of the locking channel 33 upon its vertical pivotal axis 37 in conjunction with the blocking member 43. Said blocking member can move from the locking position FIG. 2 to the unlocked position shown in FIG. 3 under the control of the actuator 55.

Figure 4:
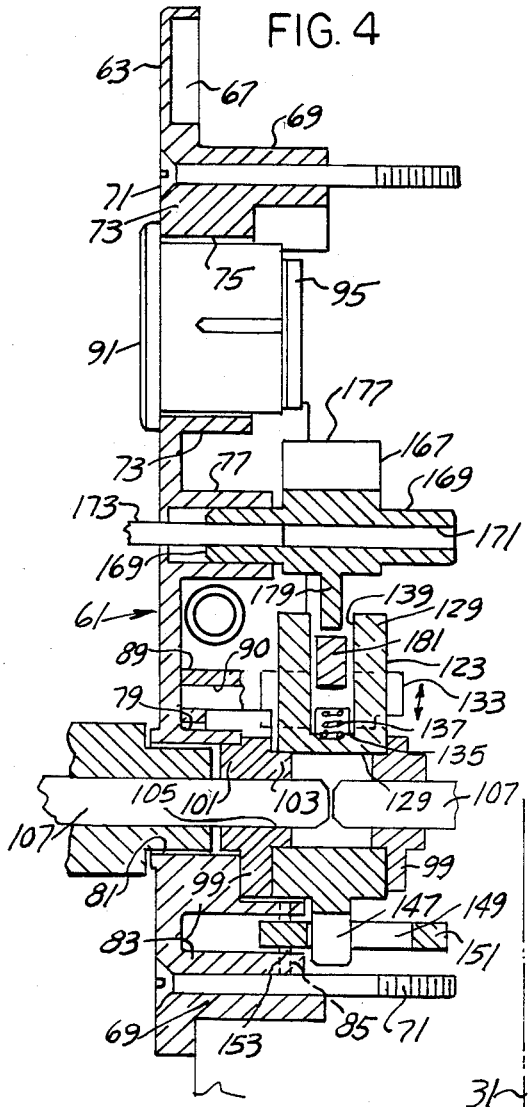
FIG. 4 is a fragmentary section taken along line 4—4 of FIG. 5 of the lock and linkage control mechanism for the locking channel shown in FIGS. 2 and 3.
Figure 5:
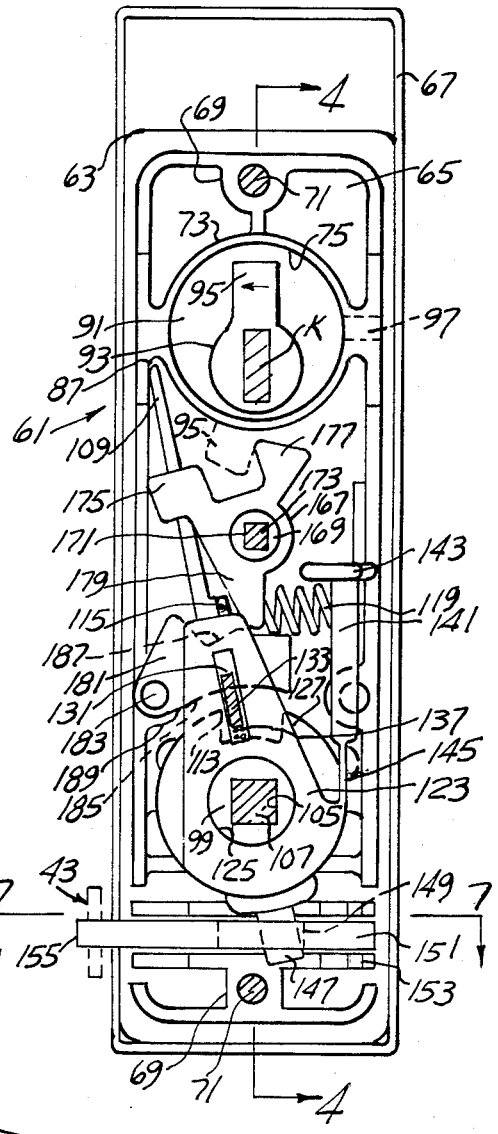
FIG. 5 is a fragmentary side elevational view of the linkage assembly with one of the escutcheons removed illustrating the adjustability of the clutch, cam, turnpiece hub and lock cylinder.

The detail of construction of the locking channel 33 and the arrangement of the blocking member 43 is not repeated, however, as shown in FIGS. 4 and 5, the actuator 151 corresponds to the actuator 55 shown in FIG. 3 and is shown in engagement with the blocking member sleeve 53, fragmentarily shown.

The function and operation of channel 33, blocking member 43, and actuator 55 are described in detail in U.S. Pat. No. 4,093,284, incorporated herein by reference.

Figure 7:
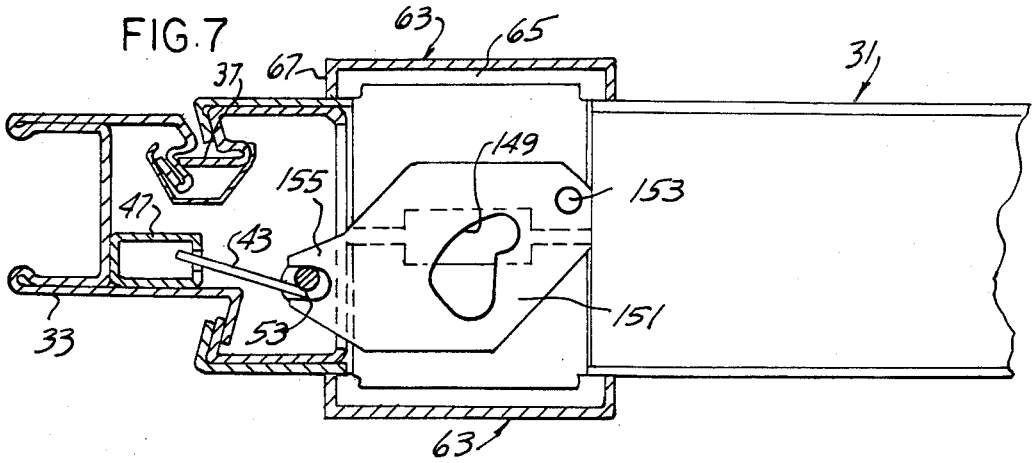
FIG. 7 is a plan section taken in the direction of arrows 7—7 of FIG. 5 similar to FIG. 2.

As hereafter described, rotary movements of the actuator 151 in a horizontal plane are adapted to rotate the blocking member 43 from the channel blocking position shown in FIG. 7 to the release position shown in FIG. 3.

The present latch and lock assembly 61, FIGS. 4 and 5, includes a pair of opposed spaced escutcheons 63, molded of plastic such as Delrin, TM, having a body 65 including a flat face and a peripheral wall 67 at right angles to said flat face. Each of the escutcheons, which are symmetrical have formed thereon at the top and bottom thereof the apertured mount bosses 69 adapted to receive fasteners 71 by which the pair of escutcheons are secured to each other in compression upon opposite sides of the door 31.

Each of the escutcheons includes an inwardly directed lock cylinder mount boss 73 having a bore 75 adapted to supportably receive cylinder lock 91 with rotatable cylinder 93 operated by a key K. As further shown in FIGS. 4 and 8, the escutcheons include the pair of opposed apertured turnpiece hub mount bosses 77 and the inwardly directed hub mount bosses 79 having a bore 81.

Arranged upon the interior of the respective escutcheons thereof are a pair of vertical spaced actuator guide mount plates 83 having opposed apertures 85 therein. Each of the escutcheons have spring lever mount recess 87 adjacent the boss 73 and opposed pairs of cam pivot mount bosses 89 apertured at 90.

The conventional cylinder lock 91, FIGS. 4 and 5 is interposed between the pair of escutcheons 63 and supportably nested within the opposed bosses 73, secured therein by the set screw 97. Cylinder 93, FIG. 5, operated by a key K includes a conventional cam 95 by which the door may be unlocked such as from the exterior thereof.

Figure 8:
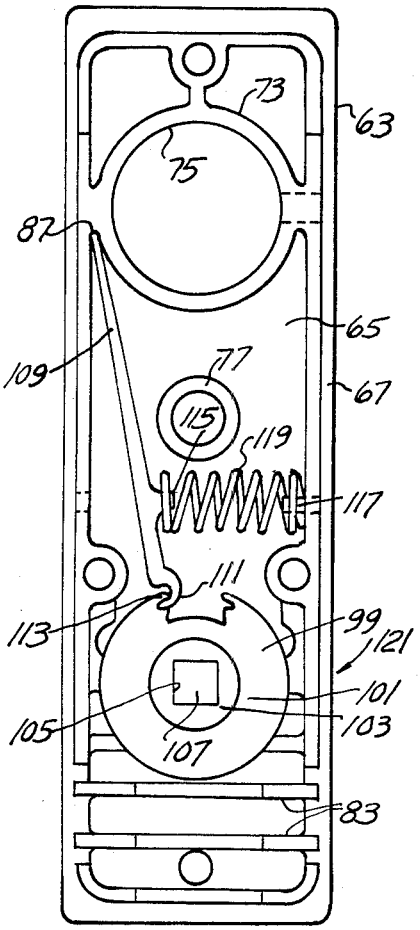
FIG. 8 is similar to FIG. 6 with parts removed for illustrating the spring bias of one of the links.

As shown in FIGS. 4, 5 and 8, a pair of spaced hubs 99 are interposed between the escutcheons 63, each hub having an annular hub support 101 projecting outwardly thereof and supportably nested and journaled within the corresponding boss 79 of said escutcheons. Each of the hubs includes upon the other side thereof a cylindrical clutch support boss 103. A square bore or hole 105 is formed through the respective bosses 101, 103 adapted to receive the lever or knob 107 as shown in FIGS. 4 and 5. With reference to the use of a lever 107, it is contemplated as equivalent that the lever can be replaced by a knob which has a portion of square cross section, FIG. 5, to cooperatively nest within the corresponding hub 99.

As shown in FIG. 8, within each of the escutcheons 63 is a substantially upright spring lever 109 anchored at one end within the mount recess 87 adjacent boss 73, and at its other end having a formed or arcuate lip 111 in operative engagement with the formed hub stop 113 within the periphery of hub 99.

Between the boss 115 upon the spring lever and the boss 117 on the escutcheon there is interposed in compression a coil spring 119 normally biasing the spring lever 109 and the corresponding hub 99 to the position shown in FIG. 8. Upon rotation of the hub by its corresponding lever 107 adapted to rotate at approximately 24 degrees clockwise, as shown in FIG. 8, spring 119 is compressed; and upon release of the lever, under the action of the spring 119 the hub and lever 109 will be biased back to the position shown in FIG. 8.

Figure 6:
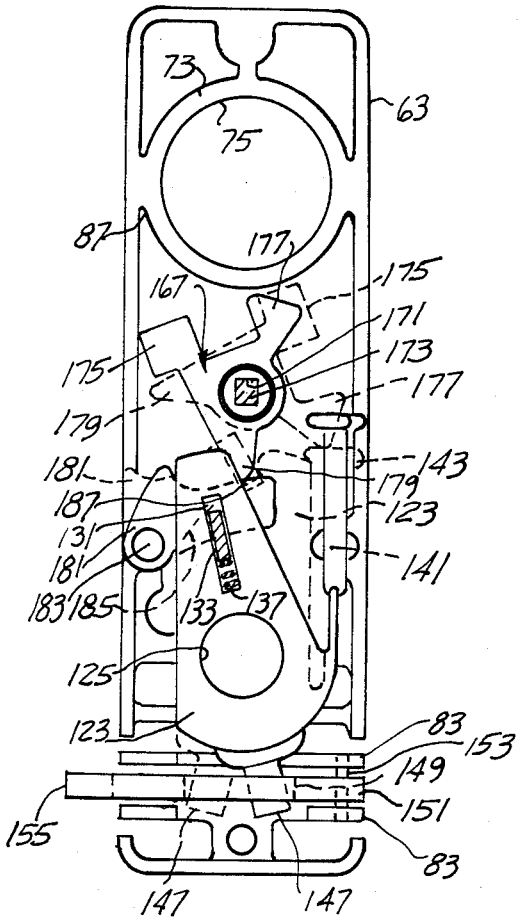
FIG. 6 is a similar view illustrating the door control linkage as unlocked under the control of the turnpiece hub and in dash lines, locked.

Referring to FIGS. 4, 5, and 6, the clutch housing 123 is constructed of plastic, such as nylon, and is interposed between the escutcheons 63 and has a transverse bore 125 intermediate its ends adapted to cooperatively receive the clutch mount bosses 103 upon the hubs 99. By this construction, the rockable clutch housing 123 is interposed between the escutcheons and supportably mounted and journaled upon the corresponding hubs 99 adapted for rotation independently of said hubs.

Said clutch housing has a tapered dog mount portion 127, FIG. 5 extending to one end of the housing, having a transverse bifurcation 129 at its upper end within which is movably positioned the cam 181 separately mounted between the escutcheons as by the support cam shafts 183 nested with in the apertures 90 of the escutcheon bosses 89.

Formed transversely of the clutch housing 123 in a dog guide and support slot 131 within which is movably positioned the elongated dog 133, which at its ends projects outwardly of the clutch housing and is adapted for selective engagement with the corresponding hubs 99. Said clutch housing radially inwardly of the slot 131 has a bore 135 within which is nested coil spring 137 engageable with the central portion 157 of the dog 133, FIG. 9, normally biasing the dog radially outward.

The bifurcated end 129 of the clutch housing defines a cam clearance slot 139 for cooperatively receiving cam 181, FIG. 5, which is adapted on rotation clockwise to move the dog 133 radially inward against the action of the spring 137.

Upright clutch actuator arm 141, FIG. 5, is spaced from clutch housing 123, has a boss 143 at its upper end and at its lower end is connected by arm support 145 tangentially to the clutch housing outwardly of its pivot mounting 103. The lower end of the clutch housing terminates in the depending control pin 147. Said pin operatively extends into a formed cam slot 149 formed within the actuator 151. Said actuator corresponds to the actuator 55 shown in FIG. 3.

Said actuator at one end has a pair of opposed pivot bosses 153 which extend through the apertures 85 in guide plates 83 of one of the escutcheons. The opposite end of the actuator includes a clevis 155 or recessed portion which receives channel blocking member sleeve 53, as shown in detail in FIG. 2.

The rotation of the clutch housing 123 is a vertical plane, for example, causes the depending pin 147 to translate to the dash line position shown in FIG. 6 and at the same time cams the actuator 151 in a horizontal plane so as to move the blocking member 43 to a release position, such as shown in FIG. 3.

With the blocking member in a release position, locking channel 33 is adapted to rotate about its vertical axis 37.

Figure 9:
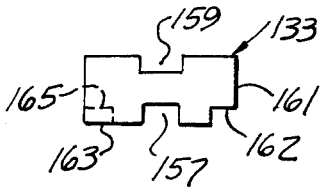
FIG. 9 is a side elevational view of the hub control dog shown in FIG. 4.

Elongated dog 133, FIG. 9 has upon its upper edge a central cam notch 159 adapted to cooperatively receive a portion of the pivotal cam 181, FIG. 5. Said dog on its undersurface has a central notch 157 adapted to receive biasing spring 137. Said spring is mounted upon the clutch housing normally biasing the dog radially outward within the clutch housing slot 131.

Said dog upon one end has an outside hub engaging member 161 which has been cut away at its undersurface as at 162 so that the end of the dog, is normally out of engagement with the outer hub 99. The opposite end of the dog 133 has an inside hub engaging member 163 so that in the radially outward position of the dog, said dog is nevertheless in engagement with the inside hub 99 upon the door, FIG. 4.

In an option modification of the present construction, the dog 133 at the inside hub engaging member 163 may be cut-away as at 165, shown in dash lines, so that in its normal outwardly biased position the dog would be out of engagement with the interior hub, unless the cam 181 is lowered biasing the dog radially inward upon the clutch housing 123.

Positioned within and between the escutcheons 63 is a rotatable turnpiece hub 167 having upon its opposite sides a pair of opposed cylindrical supports 169 adapted for cooperative supporting and journaling registry within the escutcheon apertured bosses 77, FIG. 4.

The turnpiece hub has a square hole 171 adapted to receive, normally from the interior of the building or room, the turnpiece 173 which is rotatable between the unlocked position shown in FIG. 5 to the dash line lock position shown, FIG. 6.

Said turnpiece hub, preferably constructed of Nylon, TM includes detent 175, cam detent 177 and the depending cam arm 179.

In the solid line unlocked condition of the turnpiece hub, FIG. 5, cam arm 179 is in operative engagement with the top surface of the cam 181, preferably made of Nylon, whose opposed support shafts 183 at one end thereof are journaled within the escutcheon bosses 89 on its opposite sides. Said cam extends into the clutch slot 139 between its bifurcations 129 at the upper end thereof. Said cam includes upon its bottom a dog operating surface 185 which extends into the slot 159 of the dog 133 holding the dog radially inward upon the clutch housing against the action of its spring 137.

In such unlocked position of the turnpiece hub 167, cam arm 179 has depressed the cam 181 to the position shown so that the dog 133 has been moved radially inward and wherein the end portion 161 of said dog is in operative engagement with the outer hub 99.

The top surface of the cam 181 has an upwardly projecting cam detent 187 against which the turnpiece hub cam arm 179 bears as shown in FIGS. 5 and 6. The turnpiece hub 167 may be manually rotated by the turnpiece 173 from the unlocked position shown in FIGS. 5 and 6 to the dash line locking position so that the turnpiece hub has become disengaged from the cam 181. Accordingly, the clutch housing spring 137 is effective for moving the dog 133 radialy outwardly disengaging the dog from the outer hub and rendering the outer knob or lever inoperative so that the door is actually locked from the outside or from one side thereof.

By the present construction of one of the levers, such as the inner lever, on the door is operative for unlatching the door. For this purpose, the inner lever upon rotation rotates the corresponding inner hub which through the dog 133 rotates the clutch housing 123 to the secondary position shown in dash lines. This causes a corresponding rotation in a horizontal plane of the actuator 151 moving the channel blocking member 43 to a channel release position. Accordingly, on rotating the door 31 upon its hinge 17, FIG. 1, the locking channel 33 will take the position shown in FIG. 3 permitting the door to open in the direction of the arrow.

Assuming that the turnpiece hub is in the locked dash line position, shown in FIG. 6, the outer hub and lever are incapable of unlocking or unlatching the door, since it is in a locked condition, with the outer hub disconnected from the clutch housing.

The door may nevertheless by opened by a key K inserted within the rotatable cylinder 93 of the cylinder lock 91 supported and suspended within and between the escutcheons 63. Cylinder 93 when rotated in the direction of the arrow, FIG. 5, causes a corresponding rotation of its cam 95 which is in engagement between a pair of detents 175 and 177 on the turnpiece hub. The turnpiece hub rotates so that cam detent 177 operatively engages the actuator arm 141 connected to the clutch housing 123. This will cause the clutch housing to rotate clockwise to the dash line position shown in FIG. 6. This causes a corresponding rotation in a horizontal plane of the actuator 151 moving the channel blocking member 43 to a release position and permitting opening of the door.

In accordance with the present invention, the present door can be adjusted as a passage door, so that it may be opened by rotation of the lever on either side thereof, a privacy door which may be opened from one side only, a patio door, a communicating door, an entry door, a classroom door, storeroom door, apartment door, dormitory door, storage door, hotel door or a deadlock mechanism.

Each of these changes and functions can be obtained merely by slight modification of the escutcheons or the positioning of the respective parts therein which form the part of the linkage assembly particularly as shown in FIG. 5.

Keeping in mind that the door is locked when the channel 33, FIG. 2 is in alignment with the door and in engagement with the frame locking abutment 35, and retained in this position by blocking member 43. When the channel 33 is rotated such as to the position shown in FIG. 3, the door is unlocked or unlatched permitting opening thereof as shown by the arrow.

The present invention provides control mechanism for the locking channel 33 and in particular the blocking member 43, therefore and the sleeve 53 connected thereto, FIG. 3 and FIG. 7 by which the channel blocking member 43-53 may be locked and retained in the position shown in FIG. 2 or may be moved to a release position a shown in FIG. 3.

In all cases, the positioning of the blocking member 43 is determined by the rotary pivotal movement of the actuator 55 of FIG. 3, or the actuator 151 shown in FIG. 5. The said actuator rotates at a horizontal plane so as to move the blocking member to the position shown in FIG. 3 corresponding to its release position. In such position, channel 33 is free to rotate counterclockwise or outwardly upon applying a push to the door through either of its levers or knobs 107.

In accordance with the present invention, the lever handles or knobs disclosed herein are effective for controlling the total door latching and unlatching the same with respect to the door frame. Either a lever handle or a knob may be employed for this purpose.

The lever or knob is engageable or disengageable from the corresponding hub which control rotation of the clutch housing by means of the movable dog that can be controlled by a cylinder 91 and a key K, or may be controlled by the turn piece hub. Accordingly, the turnpiece member, while it may be employed for operating the clutch housing to unlatch the door, it is primarily used for placing the door in an locked or unlocked condition. Accordingly, the present door construction may be locked with respect to the frame without the use of bolts or dead bolts.

The present lever mechanism and locking linkage is adapted to effect locking and unlocking of the door and functions without use of a separate housing with all of the mechanism being supportably positioned and journaled upon the pair of opposed escutcheons secured to the door on opposite sides thereof. The escutcheons position the linkage mechanism components and supportably journal the same so that no further housing is required.

All the normal operating functions of this door construction and lock are obtainable, without additions or substractions of the parts merely be adding or removing holes in the escutcheons, substituting escutcheons for controlling the operation. For example, an escutcheon may be provided which would prevent access to the turnpiece hub from the outside of the door, or from both sides of the door. The turnpiece hub functioning under the control of the lock cylinder is adapted for unlatching and unlocking the door from the outside. A lever or knob being employed for unlatching or unlocking the door from one side.

The angular positioning of the turnpiece within the turnpiece hub on one side of the door visibly indicates whether the door is locked or unlocked.

Having described my invention, reference should now be had to the following claims:

I claim:

1. In a door hinged to a frame having a locking channel pivotally mounted upon a vertical axis upon its closing edge aligned with the door and interlocked with an elongated engaging element upon the frame, said channel being sufficiently movable relative to the door that it disengages said engaging element so that the door may open, and a blocking means movably mounted upon the door in one position retaining the channel in a locked position when the door is closed and movable to a release position;

the improvement comprising;

a lever rotatably mounted upon said door;

and a linkage means movably mounted upon the door interconnecting said lever with said blocking means;

said linkage means including an actuator movably mounted at one end within the door and at its other end operatively engaging said blocking means;

said linkage means further including a clutch housing movably mounted upon the door and having a depending actuating surface;

said actuator having a cam surface therein operatively receiving said actuating surface whereby movement of said clutch housing moves said actuator, said actuator on pivotal movement moving said blocking means to its release position, so that said channel moves to disengage said engaging element;

said linkage means further including spaced opposed inner and outer hubs upon opposite sides of said clutch housing movably mounted upon said door and supporting said clutch housing;

said lever being projected into one of said hubs.

2. In the door of claim 1, said linkage means further including a dog mounted upon said clutch housing, and at one end operatively connected to one of said hubs, whereby rotation of said lever moves said clutch housing.

3. In the door of claim 2, a second lever projected into the other of said hubs, the other end of said dog being normally spaced from said other hub, said dog being yieldably mounted upon said clutch housing for movements thereon;

and a cam movably mounted upon said door and engaging said dog, movement of said cam moving said dog into operative engagement with said other hub, whereby rotation of said second lever moves said clutch housing.

4. In the door of claim 3, said clutch housing having a transverse slot receiving said dog;

and biasing means normally biasing said dog out of engagement with said first hub.

5. In the door of claim 4, and a control means movably mounted upon said door having cam surfaces thereon;

said control means being movable between an unlocked and locked position;

said cam surface engaging said cam in an unlocked position, depressing said cam and said dog into operative engagement with said other hub rendering said second lever operable to move said clutch housing, the door remaining unlocked relative to said second lever while the control means remains in its unlocked position;

movement of said control means to its locked position disengaging its cam surface from said cam, said dog automatically disengaging from said other hub rendering said second lever inoperative.

6. In the door of claim 1, said linkage means further including a clutch actuator arm spaced from said clutch housing and at one end tangentially connected thereto outwardly of its mounting, a control means rotatably mounted upon said door, said control means having cam surfaces;

movement of said control means moving one of said cam surfaces into operative engagement with said actuator arm for moving said clutch housing.

7. In the door of claim 6, a key operated lock cylinder journaled upon said door having a depending cam extending to the cam surfaces, rotation of said cylinder cam moving said control means.

8. In the door of claim 1, said linkage means further including a dog mounted upon said clutch housing;

said dog being normally spaced from said hubs;

a second lever projected into the other of said hubs;

said dog being yieldably mounted upon the clutch housing for movements thereon;

and a cam movably mounted upon said door and engaging said dog;

rotation of said cam depressing said dog into operative engagement with said hubs whereby movement of either of said levers moves said clutch housing.

9. In the door of claim 8, said clutch housing having a slot receiving said dog;

said dog yieldable mounting including a coiled spring interposed in compression between said clutch housing and dog normally biasing said dog out of engagement with said hubs.

10. In the door of claim 9, and a control means movably mounted upon said door, said control means having cam surfaces thereon;

said control means being movable between an unlocked and locked position;

said cam surfaces engaging said cam when said control means is in an unlocked position moving said cam and said dog into operative engagement with said hubs rendering said levers operative to move said clutch housing;

the door remaining unlocked relative to said levers while the control means remains in its unlocked position;

movement of said control means to its locked position disengaging a cam surface from said cam, said dog disengaging from said hubs rendering said levers inoperative.

11. In the door of claim 3, said linkage means further including a clutch actuator arm spaced from said clutch housing and at one end connected thereto outwardly of its movable mounting, a control means movably mounted upon said door having cam surfaces;

and a key operated rotatable lock cylinder journaled upon said door having a depending cam extending to said cam surfaces;

rotation of said cylinder cam rotating said control means and one of said cam surfaces into operative engagement with said actuator arm moving said clutch housing;

the mounting of said hubs, clutch housing, actuator, cam, control means and lock cylinder including a pair of spaced opposed escutcheons secured to opposite sides of the door, therebeing opposed bosses upon the interior of said escutcheons, said hubs having annular supports journaled within and supported upon corresponding bosses of said escutcheons;

said clutch housing being interposed between said hubs and movably mounted upon said hubs;

said cam having opposed shafts journaled upon said escutcheons;

said control means having opposed cylindrical supports journaled and supported upon corresponding bosses of said escutcheons;

said lock cylinder spanning and supported upon corresponding bosses of said escutcheons;

and said actuator pivotally mounted upon one of said escutcheons and projecting outwardly thereof.

12. In the door of claim 1, the mounting of said hubs and clutch housing including a pair of spaced opposed escutcheons mounted and secured upon opposite sides of said door, therebeing a pair of opposed apertured circular bosses upon and extending inwardly of said escutcheons;

said hubs having outer annular supports mounted and journaled within corresponding bosses of said escutcheons;

said hubs having inner annular bosses upon which said clutch housing is supported an journaled;

said escutcheons serving as the sole mounting and support for said hubs and clutch housing.

13. In the door of claim 12, fasteners interconnecting said escutcheons in compression relative to said door.

14. In the door of claim 12, a pair of apertured parallel spaced guide mount plates upon and extending inwardly of said escutcheons;

said actuator being guidably positioned between said guide mount plates and at one end pivotally mounted thereon, with its other end projected laterally out from said escutcheons for engagement with said channel blocking means.

15. In the door of claim 12, a spring lever at one end retainingly mounted within each escutcheon and at its other end having a lip retainingly engaging a hub, respectively;

and spring means interposed between each spring lever and escutcheon;

rotation of a hub by its lever pivoting said spring lever from an initial position compressing said spring means;

said spring means on release of said lever automatically returning said hub and spring lever to its initial position.

16. In the door of claim 12, there being additional inwardly directed opposed pairs of apertured bosses upon said escutcheons positioned within said door;

said linkage means further including a dog extending transversely through and mounted upon said clutch housing and at one end operatively connected to one of said hubs whereby rotation of said lever rotates said clutch housing;

a second lever projected into the other said hubs, the other end of said dog being normally spaced from said other hub;

said dog being yieldably mounted upon said clutch housing for radial movements thereon, a cam pivotally mounted upon said door and engaging said dog;

said cam including outwardly projecting support shafts journaled upon said escutcheons;

rotation of said cam depressing said dog into operative engagement with said other hub whereby rotation of said second lever rotates said clutch housing;

a turn piece hub rotatably mounted upon said door having peripherally spaced detent, cam detent and cam arm thereon, said turn piece hub having a pair of oppositely extending bosses supportably jounaled upon said escutcheons;

said turn piece hub being rotatable between an unlocked and a locked position;

said cam arm engaging said cam when said turnpiece hub is in an unlocked position, depressing said cam and said dog into operative engagement with said other hub, said second lever being operable to rotate said clutch housing;

the door remaining unlocked relative to said second lever while the turn piece hub remains in its unlocked position;

rotation of said turnpiece hub to its locked position disengaging said cam arm from said cam, said dog automatically from said other hub rendering said second lever inoperative;

and a key operated rotatable lock cylinder journaled upon and extending between and supported upon said escutcheons, and having a depending cam extending between said detents;

rotation of said cylinder cam rotating said turnpiece hub.

17. In the door of claim 3, a turnpiece hub rotatably mounted upon said door having spaced detents thereon, said turnpiece being rotatable between an unlocked and locked position;

one detent engaging said cam when said turnpiece is in an unlocked position depressing said cam and said dog into operative engagement with said other hub rendering said second lever operative to rotate said housing;

the door remaining unlocked relative to said second lever when the turnpiece hub remains in its unlocked position;

rotation of said turnpiece hub to its locked position disengaging a detent from said cam, said dog automatically disengaging from said other hub rendering said second lever inoperative;

said linkage means further including a clutch actuator arm spaced from said clutch housing and at one end tangentially connected thereto outwardly of its pivotal mounting;

said turnpieced hub on manual rotation adapted to operatively engage said actuator arm for rotating said clutch housing, and a key operated rotatable lock cylinder journaled upon said door having a depending cam extending into engagement with said turnpiece hub;

selective rotation of said cylinder cam rotating said turnpiece hub into operative engagement with said actuator arm for rotating said clutch housing;

said turn piece hub being indepedently rotatable for unlatching said door;

said lock cylinder being selectively rotatable to operatively and drivingly engage said turnpiece hub unlatching said door.

* * * * *